United States Patent [19]

Johnson

[11] 4,040,574

[45] Aug. 9, 1977

[54] METHOD AND APPARATUS FOR REPLACING A ROLL OF POLYSTYRENE FOAM SHEET WITH EMPTY CORE ROLL

[75] Inventor: David Emil Johnson, Macedon, N.Y.

[73] Assignee: Mobil Oil Corporation, New York, N.Y.

[21] Appl. No.: 665,486

[22] Filed: Mar. 10, 1976

[51] Int. Cl.[2] ..... B65H 19/20

[52] U.S. Cl. ..... 242/56 A

[58] Field of Search ..... 242/56 A, 56 R, 64; 156/191; 53/118

[56] References Cited

U.S. PATENT DOCUMENTS

| | | | |
|---|---|---|---|
| 2,668,023 | 2/1954 | Whitson | 242/56 A |
| 3,350,027 | 10/1967 | Egan | 242/56 R X |
| 3,720,381 | 3/1973 | Rehme | 242/56 R |
| 3,744,730 | 7/1973 | Burnage | 242/56 A |
| 3,911,641 | 10/1975 | Miller | 53/118 |

*Primary Examiner*—Edward J. McCarthy

*Attorney, Agent, or Firm*—Charles A. Huggett; James D. Tierney

[57] ABSTRACT

A surface winder for forming mill rolls of sheet material such as polystyrene foam sheet features a surface winder with an automatic web or sheet material transfer arrangement whereby a full mill roll is displaced and replaced by an empty core. The empty core automatically receives the severed end of the web and the winding operation continues on the empty core in an uninterrupted fashion.

6 Claims, 4 Drawing Figures

Figure I
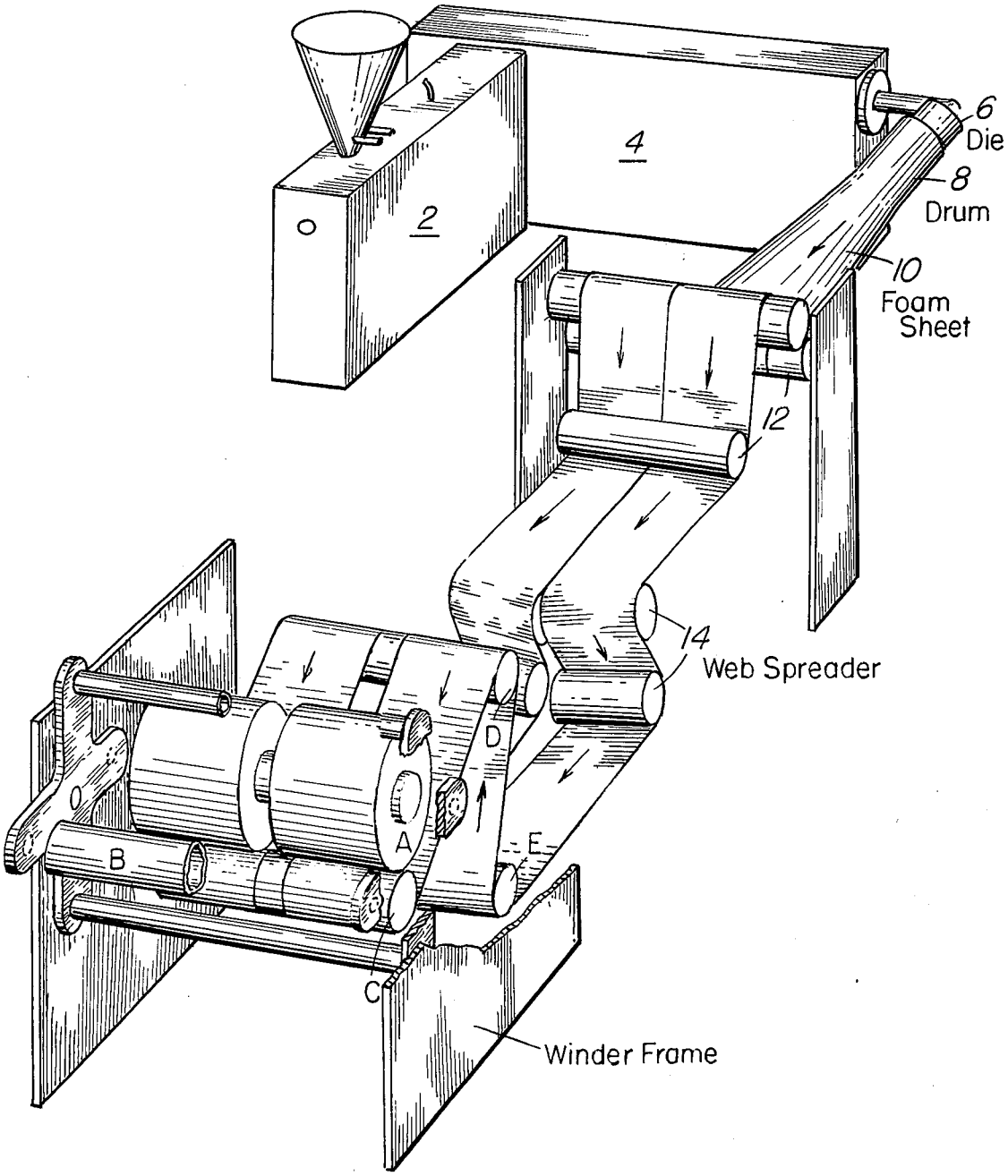

Figure II
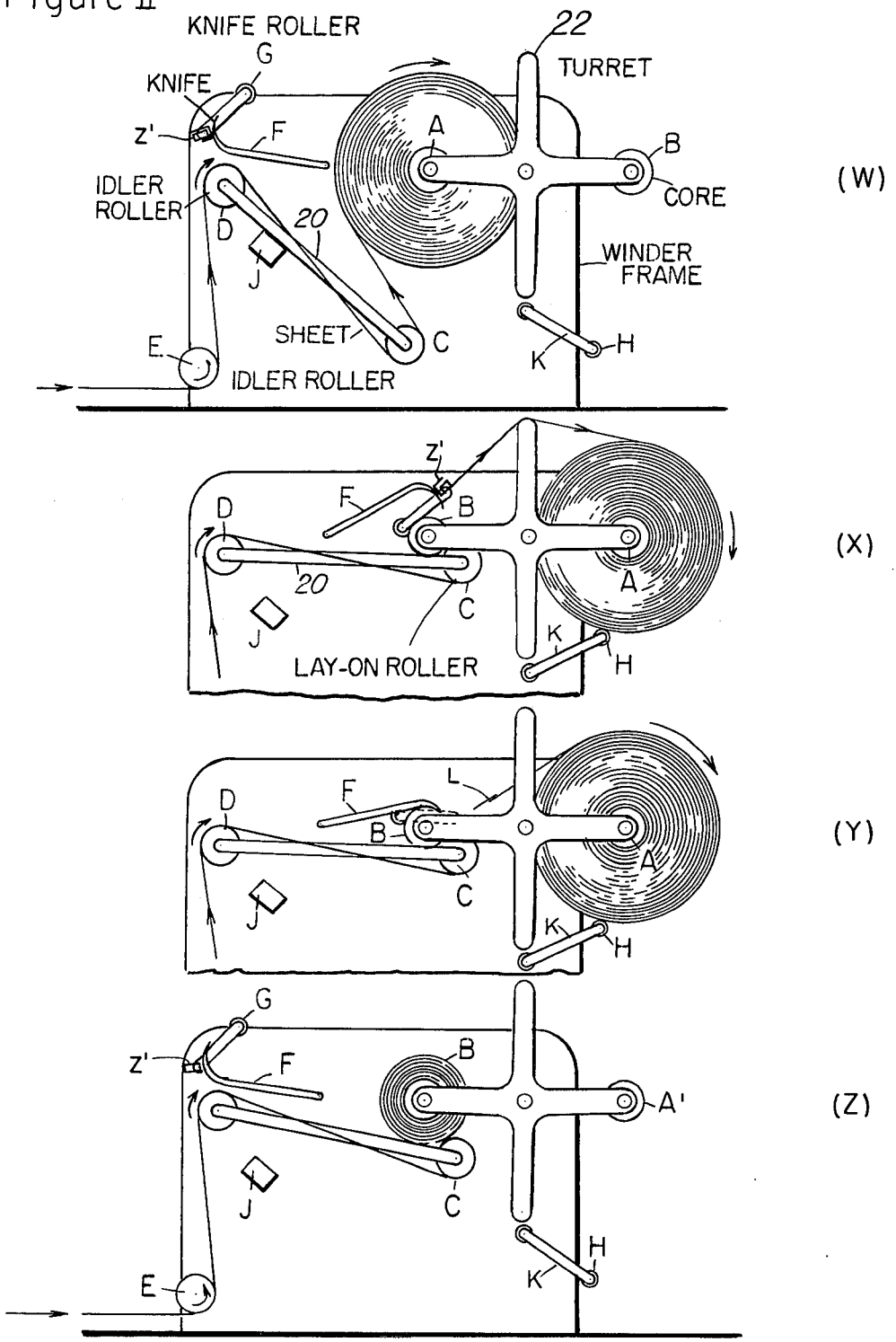

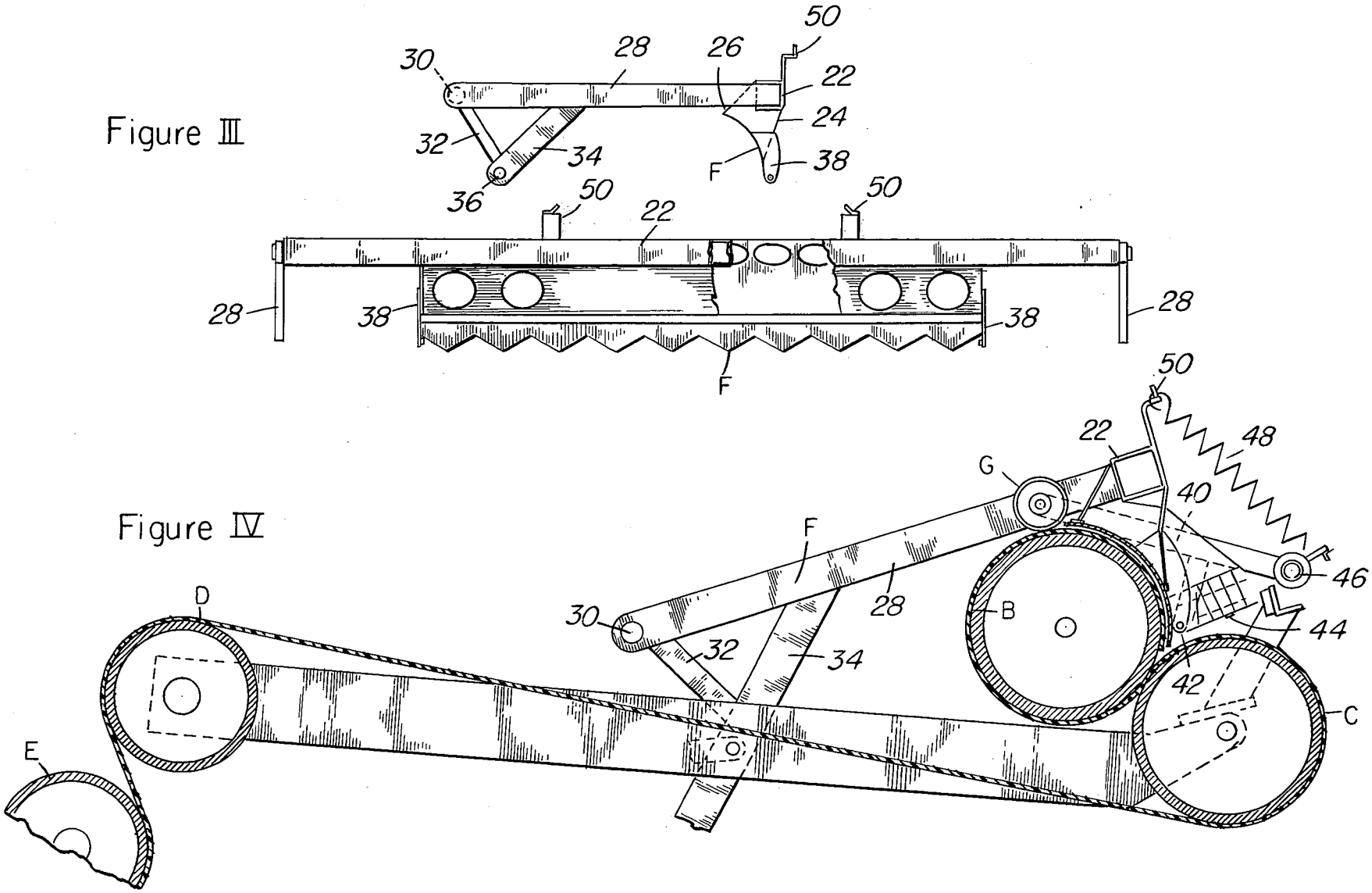
50
22
24
38
26
F
28
34
36
30
32
50
22
50
38
28
38
F
28
Figure III
46
44
C
48
40
42
50
22
G
B
28
F
34
32
30
D
E
Figure IV

METHOD AND APPARATUS FOR REPLACING A ROLL OF POLYSTYRENE FOAM SHEET WITH EMPTY CORE ROLL

FIELD OF THE INVENTION

This invention is concerned with producing thermoplastic foam in long sheets of desired width and thickness wound on rolls. It is also concerned with the method and apparatus for extruding polystyrene thermoplastic material into large long flat sheets which are wound on one or more core rollers. In a more particular aspect, the present invention is concerned with an automated transfer apparatus arrangement for severing the thermoplastic sheet after a roll thereof has reached a desired diameter and a core roller is substituted and takes up the severed extruded foam sheet for forming another roll thereof without interruption of the process. In a particular aspect, the present invention is concerned with forming rolls of extruded foam sheet under particular conditions of desired linear tension by a mechanical arrangement and winding system which employs a driven surface lay-on roller arrangement providing linear tension on the web up to about 15 pounds per linear inch of web width both before and after engagement with the fresh core roller by the lay-on roller. The method for forming and extruding thermoplastic foam through a die is discussed in U.S. Pat. No. 3,482,006 and is a part of this invention to the extent that is provides a sheet of extruded polystyrene thermoplastic material.

SUMMARY OF THE INVENTION

This invention is concerned with forming large mill type rolls of polystyrene foam sheet material. In a more particular aspect, the present invention is concerned with the continuous formation of large rolls of foam sheet material in an automatic changing environment whereby a full mill roll is displaced and replaced by a empty core roll. In yet another aspect, the present invention is concerned with the method and apparatus for severing the web of polystyrene sheet material after reaching a desired roll size and nipping the severed web to an empty core in a continuous and substantially uninterrupted manner.

FIG. I is an diagrammatic sketch or a polystyrene foam sheet extruding system with extruded foam sheet winder recovery system and apparatus.

FIG. II is a schematic sequence of four operational steps for replacing a full roll with an empty core in the winder system of FIG. I.

FIG. III is a cross section and end view of the knife severing apparatus used in the winder system of FIG. I.

FIG. IV is a cross sectional view of the knife severing apparatus and its relationship in the winder system of FIG. I and II.

Referring now the FIG. I, there is shown apparatus for mixing and heating a polystyrene feed material in section 2, a blowing an cooling section 4 communicating with the die section 6. The extruded polystyrene is conically expanded before passing over a cylindrical drum section 8. In one arrangement not shown, a knife is provided, adjacent the end of the drum which longitudinally severs the extruded cylinder on at least one side to form when opened a sheet of polystyrene foam material 10. The extruded sheet material thus formed is than passed over a sequence of rollers 12. The extruded sheet may be slit longitudinally before passing over the rollers to provide separate continuous sheets of the same or a different width as desired. In the arrangement of FIG. 1, the width of the continuous sheets are substantially the same. These sheets, thus formed, are then passed over canted rollers 14 which spread the web (polystyrene sheet) apart a sufficient amount for forming separate rolls of the material on a common core as shown. Spreading of the web is sufficient to accomplish the results desired. The split web passes over idle rollers E and D and then over lay-on roller C which is a driven roller in nipping contact with sheet material comprising roller A. Thus, driven roller C maintains a desired tension of about 15 pounds per linear inch of web width on the web as a function of slip and in turn drives roller A. When roller A achieves a desired wound thickness of sheet material, it is then ready to be displaced from the winding system and be replaced with an empty core.

The method and apparatus of FIG. 1 comprising the displacement and replacement sequence has been substantially automated in accordance with this invention. To operational sequence of this automated operation is particularly shown in the sequence of steps comprising FIG. II. In sketch (*w*) of FIG. II, the growing roll of material attains a preset diameter which actuates a limit switch J on lay-on roller arm 20 which signals a programmer to start the sequence of displacement and replacement. In the sequence of this invention, the programmer actuates the drives for cores A and B which heretofore has been in idle engagement. Actuating the drives of core A and B sustains the web tension in the range of 5 to 10 lbs. or more pounds per linear foot of the completed roll while the lay-on roller C is removed from contact with the surface of the foam roll. The lay-on roller C drops away from completed roll A and then the turret 22 rotates clockwise the position fresh core B into the winding position. Thus, a full roll A and core roll B change positions with respect to one another. As soon as the fresh core B is in winding position as shown in sketch (X) the programmer raises the lay-on roll C into its winding position and in touching contact with roll B. The programmer then activates the knife F and the spring loaded knife roller G, more fully discussed below, in a sequence so that the knife roller G nips the web to core roller B just before the web is cut. This sequence maintains the tension on core roller B as the knife proceeds down through the web sketch (X) and the curved knife then tucks the severed end of the web into the nip between core roller B and lay-on roller C as shown in FIG. IV. It is to be particularly noted that the curved knife at the end of its travel sufficiently circumscribes roller B to force the end of the severed web in nipping engagement with rollers B and C. Furthermore, surface lay-on roller C is juxta positioned with respect to core roller B and knife edge to encourage nipping of the edge of the severed web. In the arrangement of the sketches of FIG. II and as shown in FIG. IV, the vertical axis of lay-on roller C is to the right of the vertical axis of core roller B. In the operation above discussed, tension of the web is maintained by the lay-on roller C in touching engagement with core roller B.

Once the above sequence is accomplished, the programmer then returns knife F to its normal position shown in sketch (*z*) and shuts off the core drives for core rollers A and B. The switch is then ready to initiate the sequence above discussed when core roller B acquires a desired thickness of wound sheet polystyrene foam material referred to above in the discussion on the web.

Taping of the severed end of the web to the roll is accomplished with a tape dispensing means z' attached to the outside of the longitudinal knife and roller H on the end of arm K. Thus, when the full roll A attains the position shown in sketch (X) the programmer brings roll H in touching engagement with the roll of sheet material as shown in sketch Y. The tape L is rolled onto the sheet thus fastening the end of the web to the roll. Thereafter, the programmer returns roller H on arm K to its original position as shown in sketch W.

In a semiautomatic arrangement, the machine operator removes the full roll of polystyrene foam sheet positioned as shown in sketch Y after the severed end of the web is attached as above provided. On the other hand, in a fully automatic mode of operation, the programmer removes the full roll A of foam sheet from the turret as by positioning with a conveyor means and a fresh core is indexed into position from a supply magazine.

Features of the apparatus above briefly discussed may be better understood by reference to FIGS. III and IV. Referring now to FIG. III there is shown an end view and a side view of horizontal knife F and arm support assembly. In the views of FIG. III, the curved knife F is shown attached to bar 12 by perforated baffles 24 and 26. Knife F is provided with a searated edge as shown. Bar 22 is rigidly attached to arms 28 which are pivotably attached to the wall of the winder assembly at point 30. Rigid arm means 32 and 34 attached to arm 28 provide a fulcrum arrangement for attaching (not shown) cylinder actuating means at point 36 and controlled by the programmer above discussed. A baffle support means 38 is positioned at each end of knife F to support the roller assembly arm as shown in FIG. IV.

The assembly comprising the knife with support arm and attached roller assembly discussed with respect to FIG. II is more clearly shown in FIG. IV. In the arrangement of FIG. IV, the web of polystyrene foam material is shown passing over rollers E and D to lay-on roller C in nipping engagement with core roller B. The knife assembly of FIG. III is shown positioned so that the curved blade thereof circumscribed a substantial position of the core periphery upon which the web is to be laid and the relatively stiff sheet material is nipped between core roller and lay-on roller C. To facilitate this operation as discussed with respect to FIG II, a roller G attached to a T bar 40 and pivoted about point 42 keeps the web in contact with core roller B before the knife comprising a relatively dull cutting edge severs the web and until the knife assembly is returned to its original position by the programmer. Arm 44 of the T bar is rigidly attached to arm 40. At end 46 of the T bar is provided means for attaching one end of a tension spring 48. The opposite end of the tension spring 48 is attached to means 50 on bar 22. Thus, the assembly of FIG. IV operates in the following manner. Thus, when the knife arm 28 is activated by the programmer to sever the web, roller G initially contacts the web in nipping contact with core roller B and moves partially around the periphery of roller B as the knife severs the web and comes to rest in the postion shown by FIG. IV. In this position, it will be observed that the knife curvature and the end of the knife direct the severed end of the web between the rollers B and C thus beginning the winding of a new roll of sheet material. Thereafter, the programmer returns the knife to its original position.

Having, thus, generally described the method and apparatus of this invention and discussed specific features thereof, it is to be understood that no undue restrictions are to be imposed by reasons thereof except as defined by the following claims.

I claim:

1. In an arrangement for forming mill rolls of polystyrene foam sheet material, the method for replacing a full mill roll with a core roller and transfer of a severed end of said sheet material to said core roller which comprises a. automatically actuating rotating drives connected to a full roll of sheet material and a core roll arranged opposite one another in the turret of a winder frame when the full roll reaches a preselected diameter and without interrupting the winding of the sheet material, b. rotating the turret to replace the full roll winding position with said core roller, (b-1) bringing continuously advancing sheet into contact with said core roller, c. raise a driven sheet material lay-on roller in nipping engagement with said core roll and thereafter sever the web of the sheet material with a horizontal knife sufficiently encompassing the core roller to direct a severed end of said sheet material in nipping engagement between said lay-on roller and said core roller, d. retracting the horizontal knife from contact with said sheet material during winding of a full roll thereof and, e. initiating the sequence of step (a) above when a preselected roll diameter of sheet material is formed.

2. The method of claim 1 wherein the sheet material is wound on the roller at a web tension in the range of 5 to 10 lbs. or more per linear foot.

3. The method of claim 1 wherein the turret rotates clockwise to replace a full roll with a core roll.

4. The method of claim 1 wherein steps (a) through (e) are automatically programmed.

5. The method of claim wherein the lay-on roller is positioned with respect to the core roller and the knife blade partically circumscribing thereof to bring the severed end of the sheet material in nipping engagement with the core roller.

6. The method of claim 1 wherein the knife is provided with tape dispensing means for taping a severed end of the sheet material to the full roll.

* * * * *

UNITED STATES PATENT OFFICE

CERTIFICATE OF CORRECTION

Patent No. 4,040,574 Dated August 9, 1977

Inventor(s) David Emil Johnson

It is certified that error appears in the above-identified patent and that said Letters Patent are hereby corrected as shown below:

Column 2, line 22, "To" should read -- The --.

Column 3, line 26, "bar 12" should read -- bar 22 --.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*